US011195390B2

(12) United States Patent
Crivellaro

(10) Patent No.: US 11,195,390 B2
(45) Date of Patent: Dec. 7, 2021

(54) LIGHT-SIGNALING DEVICE FOR NAVIGATION AND A SYSTEM COMPRISING MULTIPLE LIGHT-SIGNALING DEVICES FOR NAVIGATION

(71) Applicant: Federico Crivellaro, Venice (IT)

(72) Inventor: Federico Crivellaro, Venice (IT)

(73) Assignee: Federico Crivellaro, Venice (IT)

( * ) Notice: Subject to any disclaimer, the term of this patent is extended or adjusted under 35 U.S.C. 154(b) by 0 days.

(21) Appl. No.: 16/872,539

(22) Filed: May 12, 2020

(65) Prior Publication Data

US 2020/0273301 A1 Aug. 27, 2020

(30) Foreign Application Priority Data

Jul. 12, 2019 (IT) ..... 202019000002307

(51) Int. Cl.

| | |
|---|---|
| ***G08B 5/36*** | (2006.01) |
| ***F21S 9/03*** | (2006.01) |
| ***F21V 17/12*** | (2006.01) |
| ***G08G 3/00*** | (2006.01) |
| ***F21Y 115/10*** | (2016.01) |

(52) U.S. Cl.

CPC ..... *G08B 5/36* (2013.01); *F21S 9/037* (2013.01); *F21V 17/12* (2013.01); *F21Y 2115/10* (2016.08); *G08G 3/00* (2013.01)

(58) Field of Classification Search

CPC ..... F21S 9/037; F21V 17/12; F21W 2107/30; G08B 5/36; G08B 3/00; G08B 3/02; B63B 22/166

See application file for complete search history.

(56) References Cited

U.S. PATENT DOCUMENTS

| | | | | |
|---|---|---|---|---|
| 4,626,852 | A | 12/1986 | Dodge | |
| 5,152,601 | A * | 10/1992 | Ferng | F21S 9/037 136/291 |
| 5,294,924 | A * | 3/1994 | Dydzyk | B60Q 7/00 116/63 C |
| 5,829,913 | A * | 11/1998 | Puckett | E01F 9/61 404/6 |
| 7,287,929 | B1 * | 10/2007 | Sokolowski | G08B 21/12 404/6 |
| 7,320,631 | B1 * | 1/2008 | Distefano | B63B 22/16 362/477 |
| 7,878,678 | B1 * | 2/2011 | Stamatatos | B60Q 1/2615 362/184 |

(Continued)

FOREIGN PATENT DOCUMENTS

| | | |
|---|---|---|
| CN | 201148198 | 11/2008 |
| CN | 201442645 | 4/2010 |

(Continued)

*Primary Examiner* — Leah Simone Macchiarolo
(74) *Attorney, Agent, or Firm* — Tatonetti IP

(57) ABSTRACT

A navigation aid light-signaling device includes a main body inserted in an upper extremity of a dolphin. The light-signaling device includes: fasteners for the attachment of said light-signaling device to the upper extremity of a small dolphin; at least one light source generating a directional and fixed light beam, said light beam being directed toward a second light-signaling device located at a given distance from the light-signaling device on a second dolphin, and a power supply supplying said light-signaling device.

10 Claims, 4 Drawing Sheets

(56) References Cited

U.S. PATENT DOCUMENTS

| | | | | |
|---|---|---|---|---|
| 7,997,764 | B1 * | 8/2011 | Nielson | E01F 9/615 362/249.02 |
| 8,672,505 | B1 * | 3/2014 | Hogan | F21S 9/037 362/183 |
| 9,437,109 | B1 * | 9/2016 | Stafford | F21V 23/0492 |
| 10,424,173 | B1 * | 9/2019 | Bien | F21S 9/037 |
| 2002/0105805 | A1 * | 8/2002 | O'meara | B64F 1/20 362/259 |
| 2004/0239243 | A1 | 12/2004 | Roberts et al. | |
| 2009/0129067 | A1 * | 5/2009 | Fan | F21V 23/0435 362/183 |
| 2010/0026571 | A1 * | 2/2010 | Batty | B63B 45/04 342/357.34 |
| 2011/0242819 | A1 | 10/2011 | Mitchell | |
| 2016/0159446 | A1 | 6/2016 | Covelli et al. | |
| 2016/0252071 | A1 * | 9/2016 | Phillips | H02K 35/00 290/50 |

FOREIGN PATENT DOCUMENTS

| | | | | |
|---|---|---|---|---|
| CN | 105066048 | | 11/2015 | |
| CN | 205168832 | | 4/2016 | |
| CN | 206187300 | | 5/2017 | |
| CN | 207350025 | | 5/2018 | |
| CN | 207990486 | | 10/2018 | |
| CN | 108791717 | | 11/2018 | |
| CN | 108791718 | | 11/2018 | |
| CN | 208090561 | | 11/2018 | |
| DE | 19929636 | A1 | 1/2000 | |
| DE | 20001179 | | 4/2000 | |
| DE | 10011961 | A1 | 9/2000 | |
| DE | 202006015838 | | 8/2007 | |
| EP | 210283 | A1 | 2/1987 | |
| EP | 917734 | A1 | 5/1999 | |
| EP | 2068070 | | 6/2009 | |
| GB | 2404006 | | 1/2005 | |
| GB | 2434857 | | 8/2007 | |
| KR | 100612044 | | 8/2006 | |
| KR | 20080093171 | | 10/2008 | |
| KR | 100920757 | | 10/2009 | |
| KR | 20100013193 | | 2/2010 | |
| KR | 20110033384 | | 3/2011 | |
| KR | 20110085462 | | 7/2011 | |
| KR | 20120008651 | | 2/2012 | |
| KR | 20120008741 | | 12/2012 | |
| KR | 200464572 | | 2/2013 | |
| KR | 101318261 | | 10/2013 | |
| KR | 20130007282 | | 12/2013 | |
| KR | 101384206 | | 4/2014 | |
| KR | 200474838 | | 10/2014 | |
| KR | 101662477 | | 10/2016 | |
| KR | 101677039 | | 11/2016 | |
| KR | 20170002812 | | 8/2017 | |
| KR | 20170090705 | | 8/2017 | |
| KR | 20170094590 | | 8/2017 | |
| KR | 20180023679 | | 3/2018 | |
| KR | 101852692 | | 4/2018 | |
| KR | 20180083707 | | 7/2018 | |
| WO | WO-9748134 | A1 * | 12/1997 | F21S 41/25 |
| WO | WO-03049971 | A1 * | 6/2003 | F21S 4/20 |
| WO | 200662763 | A2 | 6/2006 | |
| WO | WO-2006085339 | A2 * | 8/2006 | B82Y 30/00 |
| WO | 200711852 | A2 | 1/2007 | |
| WO | 2007133868 | A2 | 11/2007 | |
| WO | WO-2007138347 | A1 * | 12/2007 | E02B 3/064 |
| WO | WO-2016033621 | A2 * | 3/2016 | F21S 8/061 |
| WO | WO-2016083590 | A1 * | 6/2016 | F21S 9/035 |

* cited by examiner

LIGHT-SIGNALING DEVICE FOR NAVIGATION AND A SYSTEM COMPRISING MULTIPLE LIGHT-SIGNALING DEVICES FOR NAVIGATION

CROSS-REFERENCE TO RELATED APPLICATIONS

This non-provisional utility patent application claims priority to and benefit of Italian Patent Application Serial No. 202019000002307, filed Jul. 12, 2019, entitled "A Light-Signaling Device for Navigation and a System Comprising Multiple Light-Signaling Devices for Navigation," the entire contents of which is hereby incorporated herein by reference.

FIELD OF INVENTION

This invention concerns a light-signaling device for navigation and a system comprising multiple light-signaling devices for navigation.

BACKGROUND

As is known, there are numerous examples of systems and devices for navigation light-signaling devices.

In this discussion, we will use the term navigation to refer to both inland navigation (such as rivers, canals, lakes, etc.) and maritime navigation.

First of all, light-signaling devices can be installed on land or directly in the water, along a navigation route, for example.

The light-signaling devices can be installed on floating buoys, dolphins, structures anchored to the seabed, etc., or on the shore.

They are used primarily to signal a route or an obstacle. They are frequently used to signal a shoal, or to provide skippers with information about the coast, in the case of maritime navigation, or about the shore in the case of inland navigation.

Moreover, in cities like Venice, where channels constitute the primary means of communication among the islands, light-signaling devices can be positioned on dolphins that are used to direct boat traffic in the channels.

Light-signaling devices of the prior art include a light source emitting a signaling light beam. This light beam is very wide and often omni-directional.

However, there are cases where the beam has a smaller amplitude, as in the case of a lighthouse. However, even in this case, signaling is used to identify a zone.

Although widely appreciated and used, light-signaling systems of the prior art do have drawbacks.

First of all, known light-signaling devices and systems cannot be used to signal a route effectively, since they can only indicate a specific position.

For example, in poor visibility, the route between locations cannot be easily understood by skippers.

Moreover, in certain situations, as in the case of transport in cities like Venice that are especially exposed to the problem of fog, signaling devices relating to a specific position are not always sufficient to guarantee complete navigation safety.

SUMMARY OF THE INVENTION

There is therefore a need to offset the drawbacks and limitations mentioned with reference to the prior art.

There is a need for a navigation device that can signal a navigation route in a suitable and easily understandable way.

There is also a need for a signaling device that can be installed on existing structures and that is independent from an energy viewpoint.

Furthermore, there is a need for a system of devices that easily identifies a navigation route.

These requirements can be met by a light-signaling device in accordance with the claim and by a light-signaling system with multiple light-signaling devices in accordance with claim 10.

BRIEF DESCRIPTION OF THE DRAWINGS

Further characteristics and the advantages of this invention will become more apparent from the following description with preferred and non-limiting examples thereof, in which.

DETAILED DESCRIPTION

Figure 2:
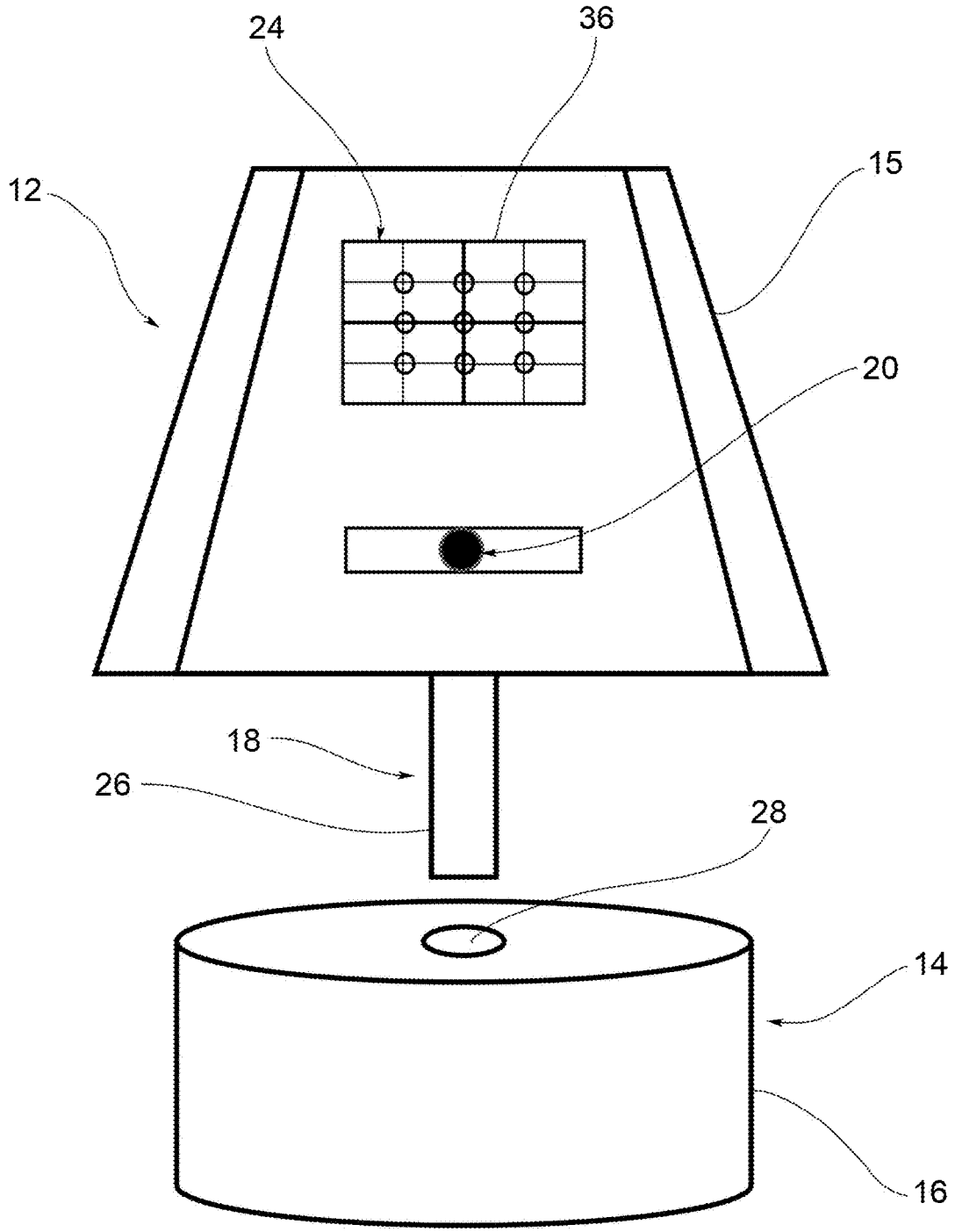
FIG. 2 is a schematic view of one possible form of a light-signaling device according to this invention

In FIG. 2, reference number 12 designates a light-signaling device assisting navigation according to this invention.

Light-signaling device 12 is composed of a main body 15 suitable for installation on the upper extremity 14 of a dolphin 16.

Light-signaling device 12 is composed of:

fastenings 18 for the attachment of light-signaling device 12 to the upper extremity 14 of a dolphin 16 at least one light source 20 generating a directional and fixed light beam 22, suitable for direction toward a second light-signaling device 12 located on a second dolphin 16 at a certain distance from the first light-signaling device 12 power supply 24 providing power for light-signaling device 12

In accordance with one possible form, the main body 15 can basically be a truncated pyramid with a hexagonal base.

In alternative forms, the main body 15 can basically be a cylinder, or a truncated cone.

Figure 4:
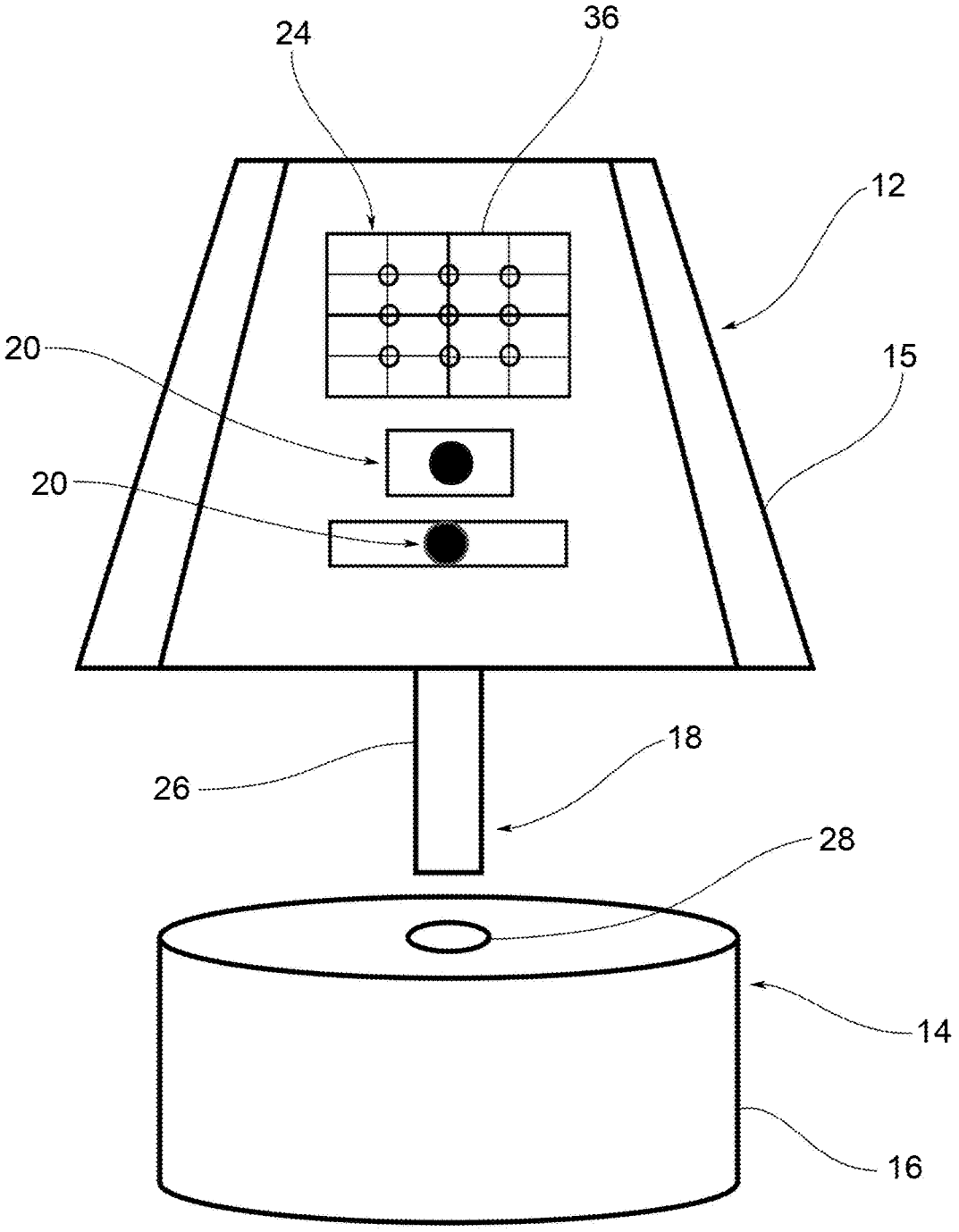
FIG. 4 is a schematic view of one alternative form of a light-signaling device according to this invention The elements or parts of elements shared by the forms described below will be indicated by the same reference numbers.

With reference to FIGS. 2 and 4, the fastenings 18 can include a pin 26 for insertion in a corresponding housing 28 at the upper extremity 14 of the dolphin 16. The pin 26 can be aligned with a surface of the main body 15 to be coupled with the upper extremity 14 of the dolphin 16.

Figure 3:
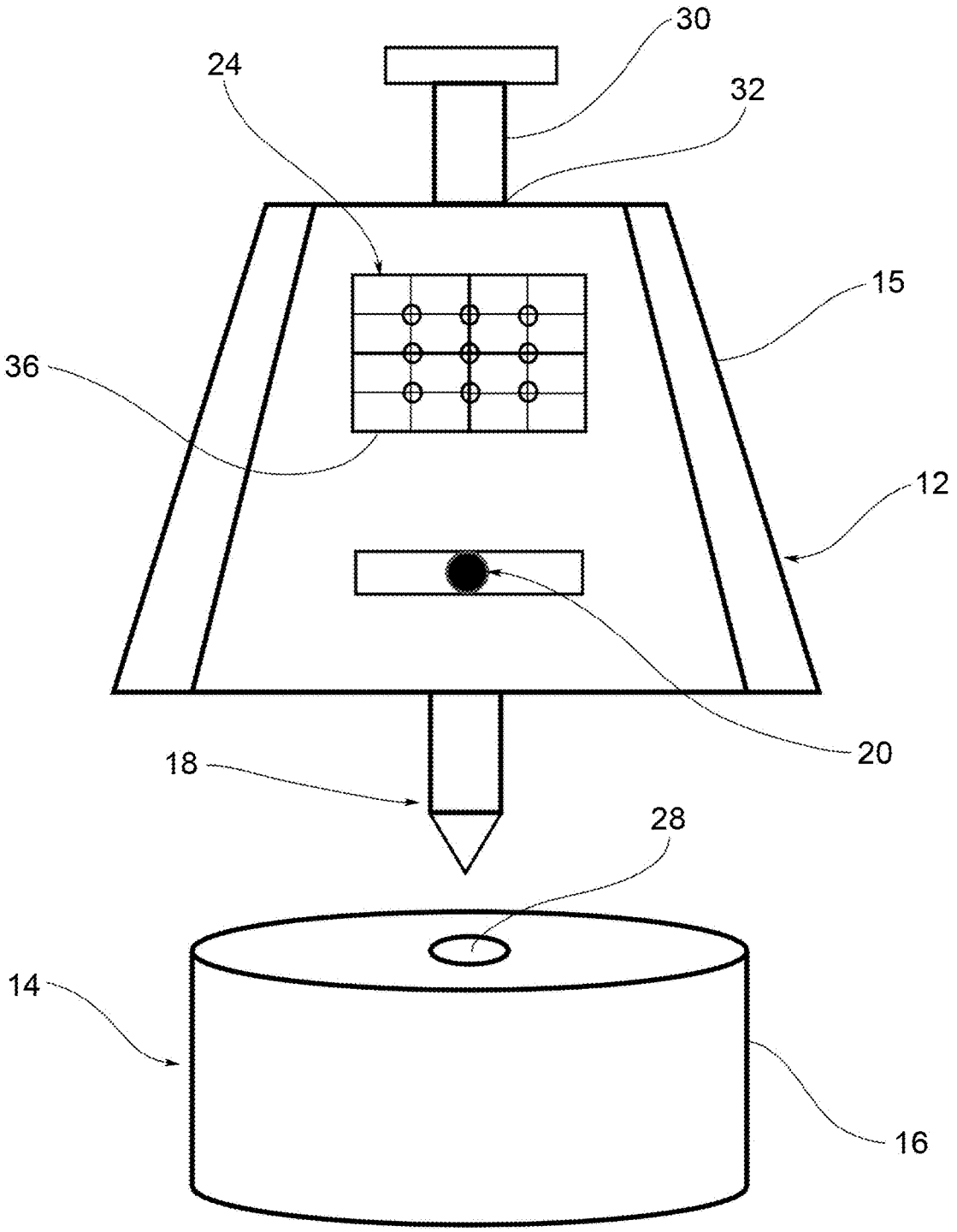
FIG. 3 is a schematic view of one alternative form of a light-signaling device according to this invention

In an alternative form shown in FIG. 3, the fastenings 18 can include a clamping screw 30 passing through a through-hole 32 on the main body 15 and screwed into a housing 28 aligned with the upper extremity 14 of the dolphin 16.

In alternative forms, not shown in the accompanying drawings, the fasteners 18 can be of a different type, such as an outer ring fastened around the upper extremity of dolphin. In alternative forms, the fasteners 18 can be hooks, or a toothed ring fastened around the upper extremity of the dolphin. Advantageously, the fasteners 18 can allow the possibility of being adapted to the diameter of the dolphin.

In one possible form, the light source 20 generating a directional and fixed light beam 22 is a laser light source.

According to one possible form, the laser light source can emit a category 1, 1M, 2, 2M, 3A, 3B, or 3R laser light beam, which poses no danger for the eyes.

For example, the laser light beam can be green, with a wavelength of 532 nm. Advantageously, green light is especially visible in conditions of poor visibility, such as fog, snow, rough sea, etc.

In alternative forms, the light beam can have a wavelength of between 400 and 700 nm.

The power absorbed by the source can be between about 1 milliwatt and 5 milliwatt.

Advantageously, the laser light source is an economical solution, with low energy consumption.

According to one possible form, the laser light source can include lenses to modify the amplitude or shape of the light beam.

According to one possible alternative form, at least one light source 20 generating a directional and fixed light beam 22 is an LED light source.

According to one possible form, the LED light source can include an LED diode. Advantageously, the LED diode can generate a cold white light beam. This solution can be particularly well suited to night conditions.

According to one possible form, the LED light source can include lenses to modify the amplitude or shape of the light beam.

The light-signaling device 12 can include a light source 20 for each of the six sides of the main body 15.

Alternative forms are possible in which the light-signaling device is equipped with two or three light sources 20.

According to one possible form, the light-signaling device 12 can include two light sources 20 at different heights on the same side.

This technical solution can be particularly suitable for boats of different heights.

Moreover, the light-signaling device 12 can include two light sources 20 of different types located at different heights on the same side. For example, a laser source and an LED source can be used.

According to alternative forms, multiple light sources can be inserted at different heights on the same side.

According to one possible form, the light beam generated by at least one source can reach a distance greater than 25 meters.

Advantageously, the light beam can therefore be visible from one dolphin to another.

The power supply 24 can include at least one solar panel 36. Advantageously, the solar panel 36 can be integrated in the surface of the main body 15.

According to one possible form, the light-signaling device 12 can include an energy accumulator suitable for storing energy produced by at least one solar panel 36 to make it available when necessary.

In alternative forms, the power supply 24 can include alternative systems, such as wind devices or devices converting tidal motion into energy.

Figure 1:
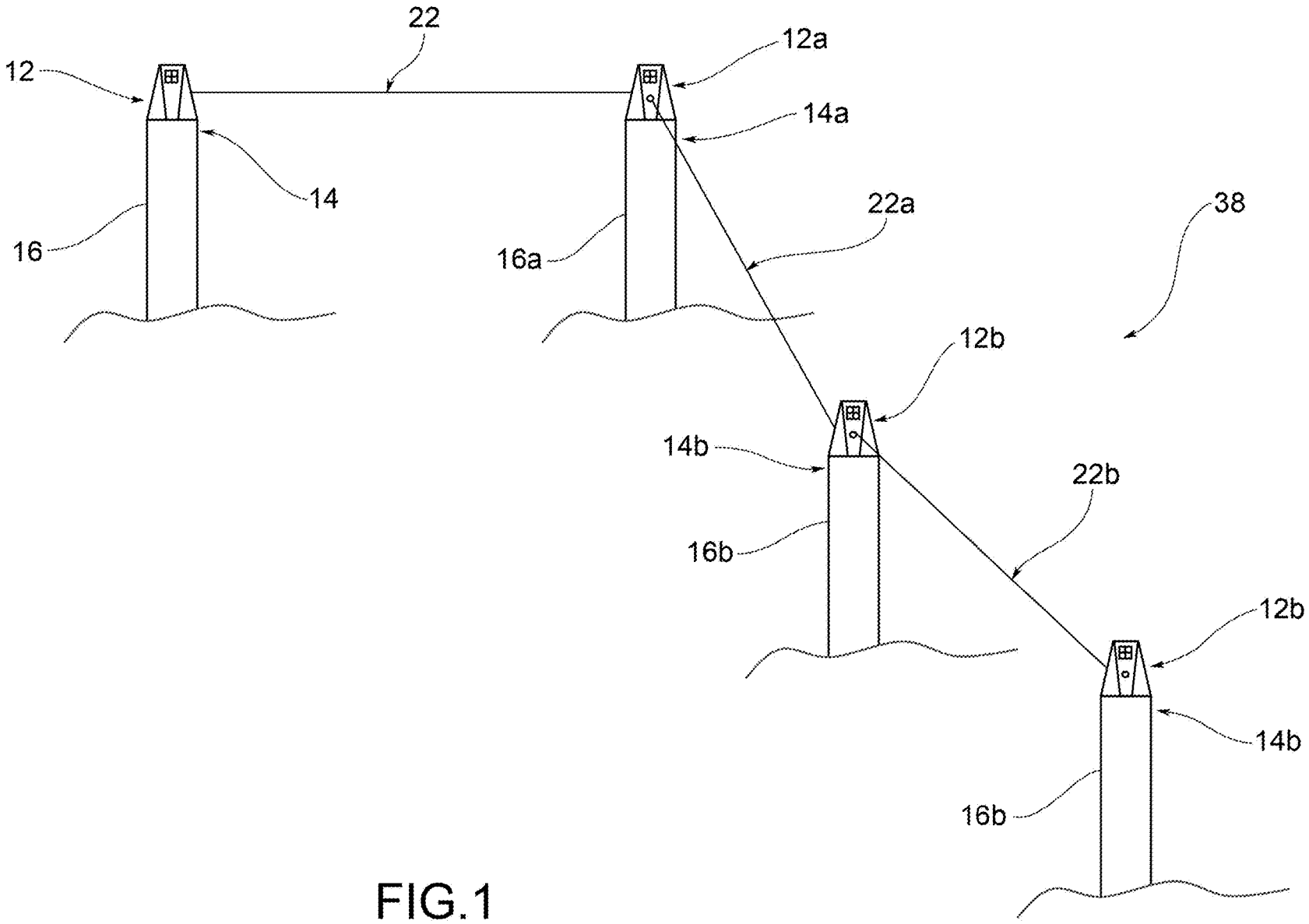
FIG. 1 is a schematic view of one possible form of a light-signaling system according to this invention

FIG. 1 shows a light-signaling system 38 comprising multiple light-signaling devices 12 of the type just described. The light source 20 of a light-signaling device 12 generates a fixed and directional light beam 22 directed toward a second light-signaling device 12A located at a certain distance from the light-signaling device 12 on a second dolphin 16A.

The figure shows a system comprising four light-signaling devices 12 in which:

the first device 12 emits a first light beam 22 directed toward a second device 12*a* the second device 12*a* emits a second beam of light 22*a* directed toward a third device 12*b* the third device 12*b* emits a third beam of light 22*b* directed toward a fourth device 12*c*

In this way, a route can be created that is clearly visible to the boats, used to delimit an area.

In this way, even if the devices are spaced far apart, the light beam provides a navigation aid between one device and the next. In one possible form, the light-signaling device 12 can be black in color, like the tip of the dolphins, so as to integrate visually with the dolphins.

The light-signaling device 12 can further include a series of accessory devices, such as:

a remote control and diagnostic device red and green sea signaling lights a channel-side indicator light motion sensors a module for rescue calls a GPS module for the detection of dolphin a module detecting the visibility status and automatically deciding whether to trigger the device, and/or devices detecting boat speed As has been seen, the invention makes it possible to render the route through navigable channels visible even in the event of fog, by using LED or laser light beams.

The system can be used at sea, in lakes or in rivers, where the safety of navigation can be put at risk by the shape of the seabed, for example.

By using the light beams emitted by one dolphin to the next, it is possible to track and then follow the navigable route, beyond which the risk of the boat running aground or against obstacles such as breakwaters, barriers, etc.

In case of fog, the improved visibility of the LED or laser light beam also makes it possible to see the dolphin itself, which would otherwise be poorly visible if not properly indicated.

Moreover, since the laser beam or LEDs are directional, and are directed toward the next dolphin, it is an advantage both because the navigable route is clearly indicated, and because the type of light emitted does not contribute to light pollution.

Laser or LED light sources are preferable because they offer high performance in terms of visibility and power consumption. In fact, a homogeneous and visible light beam can be obtained with little power regardless of the light color used.

To the forms described above, an expert can modify and or replace elements described with equivalent elements to meet specific requirements, without departing from the scope of the claims.

For example, the light-signaling device 12 can be manufactured directly with the dolphin and be a single unit with the dolphin itself.

The invention claimed is:

1. A light-signaling device for navigation assistance, comprising a main body suitable for installation at an upper extremity of a dolphin or buoy, said light-signaling device comprising:

fasteners suitable for the attachment of said light-signaling device at the upper extremity of the dolphin or buoy;

at least one light source generating a directional and fixed light beam, said light beam forming a laser that is externally directed toward a second light-signaling device located at a distance from the light-signaling device on a second dolphin or buoy, and power supply providing power for said light-signaling device.

2. The light-signaling device according to claim 1, wherein the main body is a substantially truncated pyramid with a hexagonal base.

3. The light-signaling device according to claim 2, wherein the fasteners include a pin suitable for insertion into a corresponding housing in the upper extremity of a bracket, said pin being inserted in a surface of said main body destined to be coupled with said upper extremity of said dolphin or buoy.

4. The light-signaling device according to claim 3, wherein at least one light source generating the directional and fixed light beam is a light laser source.

5. The light-signaling device according to claim 2, wherein the fasteners include a fixing screw passing through a through opening arranged on said main body and suitable for screwing into a housing at the upper extremity of the bracket.

6. The light-signaling device according to claim 5, wherein the at least one light source generating the directional and fixed light beam is an LED light source.

7. The light-signaling device according to claim 6, wherein the light-signaling device includes a light source for each of the main body's six faces.

8. The light-signaling device according to claim 7, wherein the power supply includes at least one solar panel.

9. The light-signaling device according to claim 8, further including an energy accumulator suitable for storing energy produced by at least one solar panel to make power available when necessary.

10. The light-signaling system of claim 1, further comprising lenses that adjust one or both of an amplitude or shape of the fixed light beam.

* * * * *